US005180021A

United States Patent [19]

Champion et al.

[11] Patent Number: 5,180,021

[45] Date of Patent: Jan. 19, 1993

[54] ORIENTABLE STABILIZER

[76] Inventors: Stephen E. Champion; Robert A. Philliber, both of P.O. Box 53688, Lafayette, La. 70505

[21] Appl. No.: 288,019

[22] Filed: Dec. 21, 1988

[51] Int. Cl.[5] ..... E21B 7/08

[52] U.S. Cl. ..... 175/76; 175/325.2

[58] Field of Search ..... 175/325, 61, 73, 76

[56] References Cited

U.S. PATENT DOCUMENTS

| | | | |
|---|---|---|---|
| 2,819,040 | 1/1958 | James et al. | 175/325 |
| 3,156,310 | 11/1964 | Frisby | 175/76 |
| 3,276,824 | 10/1966 | Carter | 175/325 |
| 3,933,395 | 1/1976 | Evans | 175/325 |
| 4,059,164 | 11/1977 | Farris | 175/73 |
| 4,220,213 | 9/1980 | Hamilton | 175/45 |
| 4,384,626 | 5/1983 | Derouin | 175/57 |
| 4,638,873 | 1/1987 | Welborn | 175/73 |
| 4,667,751 | 5/1987 | Geczy | 175/61 |

FOREIGN PATENT DOCUMENTS

| | | | |
|---|---|---|---|
| 222922 | 5/1985 | Fed. Rep. of Germany | 175/325 |
| 1361304 | 12/1987 | U.S.S.R. | 175/325 |
| 1139908 | 1/1969 | United Kingdom | 175/76 |

*Primary Examiner*—Terry Lee Melius
*Attorney, Agent, or Firm*—Phelps Dunbar

[57] ABSTRACT

The invention relates generally to rotary drilling equipment, and more particularly to stabilizers which are specifically adapted for use during directional drilling when only the drill bit is rotated using a down-hole motor, but which are also well suited for use during conventional drilling when the entire drill string is rotated. In a preferred embodiment, this is achieved by using three longitudinal ribs on the stabilizer body, one of which is displaced laterally in a down-hole direction and is radially oriented such that it contacts the low side of the borehole during directional drilling.

2 Claims, 2 Drawing Sheets

ORIENTABLE STABILIZER

FIELD OF THE INVENTION

This invention relates generally to rotary drilling equipment, and more particularly to stabilizers utilized during the drilling process, which are orientable and can be affixed to any section of the drill string or down-hole drilling apparatus.

BACKGROUND OF THE INVENTION

Directional drilling has become commonplace in the exploration and development of oil and gas fields throughout the world. Yet, directional drilling remains a complex science focused upon the control of a rotary drill's angular and rotational characteristics in such a manner as to allow the borehole to be drilled in conformity with a pre-established well plan. The ability to predictably reach a specific subsurface target enhances the likelihood of successful well completion and greatly reduces the expense of oil and gas exploration.

Numerous forces work upon the drill string and drill bit to induce deviation from the intended drilling plan. These forces vary with the weight applied to the drill bit, the type of formation being penetrated, the speed of revolution of the drill bit, and the angle of the borehole. Drill string stabilizers are utilized to limit the effect of forces on the direction of the bore hole by increasing the rigidity of the lower portion of the drill string. In directional drilling, drill string stabilizers serve to aid in attaining the desired deviation in the borehole angle and direction or in maintaining the borehole angle and direction once attained.

The advent and improvement of the down-hole motor has fostered the use of down-hole equipment containing an angular deviation which facilitates the "kick-off" of the bore-hole in a new direction. The down-hole motor provides for rotation of the drill bit while the drill string is held in a constant configuration, resulting in a "controlled tool-face." In this manner the borehole follows the angular deviation placed in the down hole equipment since the angle is maintained when only the drill bit rotates. Once the desired amount of deviation of the borehole is acheived, the entire drill string may be rotated which negates the angular deviation found in the down-hole equipment. This may result in excessive vibration and borehole "washout," since rotation of the angled portion of the down hole equipment can create a borehole diameter larger than the drill bit itself. Washout is generally minimized by the small angular deviations usually employed, often less than one degree.

If desired, washout can be avoided by tripping the drill string and removing the angled down-hole equipment (the "bent-sub" or "bent-housing mud motor") prior to rotation of the entire drill string. However, tripping the the drill string is a time consuming and expensive process. The recent development of down-hole equipment which can be adjusted from a bent or angled mode to a straight mode while still in the bore-hole (such as "hydraulic bent-subs") avoids washout and facilitates changing bore-hole direction or angular deviation by allowing the adjustment of the bend angle of the down-hole equipment without tripping the drill string. After use of the down-hole motor, the down-hole equipment is adjusted from a bent mode to a straight mode while still in the borehole, and drilling is continued by rotating the entire drill string.

Drill string stabilizers can play a vital role in drilling procedures using bent-subs or bent-housing mud motors. As shown in U.S. Pat. No. 4,667,751, (Geczy) the placement of concentric stabilizers along the drill string has an effect upon the deviation of the borehole. The variation of the placement of stabilizers along the drill string will result in differing borehole deviations during directional drilling. As shown in U.S. Pat. No. 4,384,626 (Derouin), the use of clamp-on stabilizers enables the placement of stabilizers at any position along the drill string, avoiding the limitations of placement inherent in stabilizers which form a part of a threaded pipe section that is made up in the drill string itself.

Yet, the advent of bent-subs and bent-housing mud motors, and the ability to adjust the angular deviation of of this equipment without tripping the drill string has created a need for new types of stabilizers which has not been addressed by the prior art. During the use of the down-hole motor the drill string does not rotate, resulting in a "controlled tool face." The down-hole equipment tends to rest upon the low side of the borehole, which is the side of the borehole closest to a true vertical bore. The drill bit can be supported and directed by a stabilizer placed near the drill bit. However, the stabilizers addressed by the prior art cannot run "full-gage," (with the same diameter as the borehole created by the drill bit), without limiting the angular and directional changes desired by the use of a bent-sub or bent-housing mud motor. Accordingly, stabilizers that run less than "full-gage" are recommended by the prior art. (See U.S. Pat. No. 4,384,626 (Derouin) at FIG. 6; and U.S. Pat. No. 4,667,751 (Geczy).

After the desired angular and directional deviation of the borehole is achieved through the use of the down-hole motor, the entire drill string is rotated. Stabilizers which are attached to, or form a part of the drill string also rotate. It can readily be seen that any stabilizer which has bore-wall bearing surfaces that are not equidistant from the axis of rotation of the drill string, or which does not run "full-gage" will not act to maintain the drill string in the center of the bore-hole. This is true of the stabilizers described in U.S. Pat. No. 4,384,626 (Derouin FIG. 6) and in U.S. Pat. No. 4,667,751 (Geczy).

Several inventions akin to stabilizers have a supporting side which seeks the low side of the borehole due to the weight of the support section. These devices purport to maintain their orientation with the low side of the bore-hole even when the entire drill string is rotated, through the use of a mandrel and sleeve arrangement. Examples of these inventions are found in U.S. Pat. No. 4,638,873 (Welborn) and U.S. Pat. No. 4,220,213 (Hamilton). These devices suffer from problems associated with the complexity of the mandrel and sleeve arrangement.

SUMMARY OF THE INVENTION

Therefore, it is an object of this invention to provide a device that furnishes support for the low side of the tool face during directional drilling using a down-hole motor, but which also stabilizes the drill string in the center of the borehole during regular drilling accomplished by rotation of the entire drill string.

It is another object of this invention to provide such a device which can operate at full-gage; that is, a device which can have a diameter equal to the diameter of the bore-hole, without interfering with the desired angular and directional deviations sought using a bent-sub or bent-housing mud motor.

It is a further object of this invention to provide such a device which has a minimum number of moving parts, requires little maintenance and works smoothly within the borehole.

Still another object of this invention is to provide a device which is simple and easy to attach to or incorporate in the drill string or down-hole equipment.

Yet another object of this invention is to provide a device which can be radially oriented easily in any position around the drill string and down-hole equipment.

Yet another object of this invention is to provide a device which can be located at various longitudinal positions along the drill string and down-hole equipment.

Still further objects and advantages of this invention shall become apparent from the following descriptions of the invention.

Accordingly, this invention provides a stabilizer adjustable to any radial orientation around the drill string and various longitudinal positions along the drill string. The tool comprises a cylindrical body to which are attached longitudinal ribs spaced around the body, with some of the ribs being off-set laterally in a down-hole direction. The tool is attached to or incorporated in the drill string or down-hole motor and utilizes interacting splines or other devices to facilitate radial adjustment. In directional drilling the laterally displaced rib or ribs are located on the low side of the bore-hole, in close proximity to the drill bit, and act to support and guide the drill bit during drilling using a down-hole motor. The drill string is held in a radially stationary, predetermined position, such that the laterally displaced rib or ribs remain on the low side of the borehole. During regular drilling, when the entire drill string is rotated, the tool acts to maintain or stabilize the drill string in the center of the borehole, since the outermost surfaces of all ribs are equidistant from the centerline of the drill string and since the stabilizer can run "full-gage."

DESCRIPTION OF A PREFERRED EMBODIMENT

Figure 1:
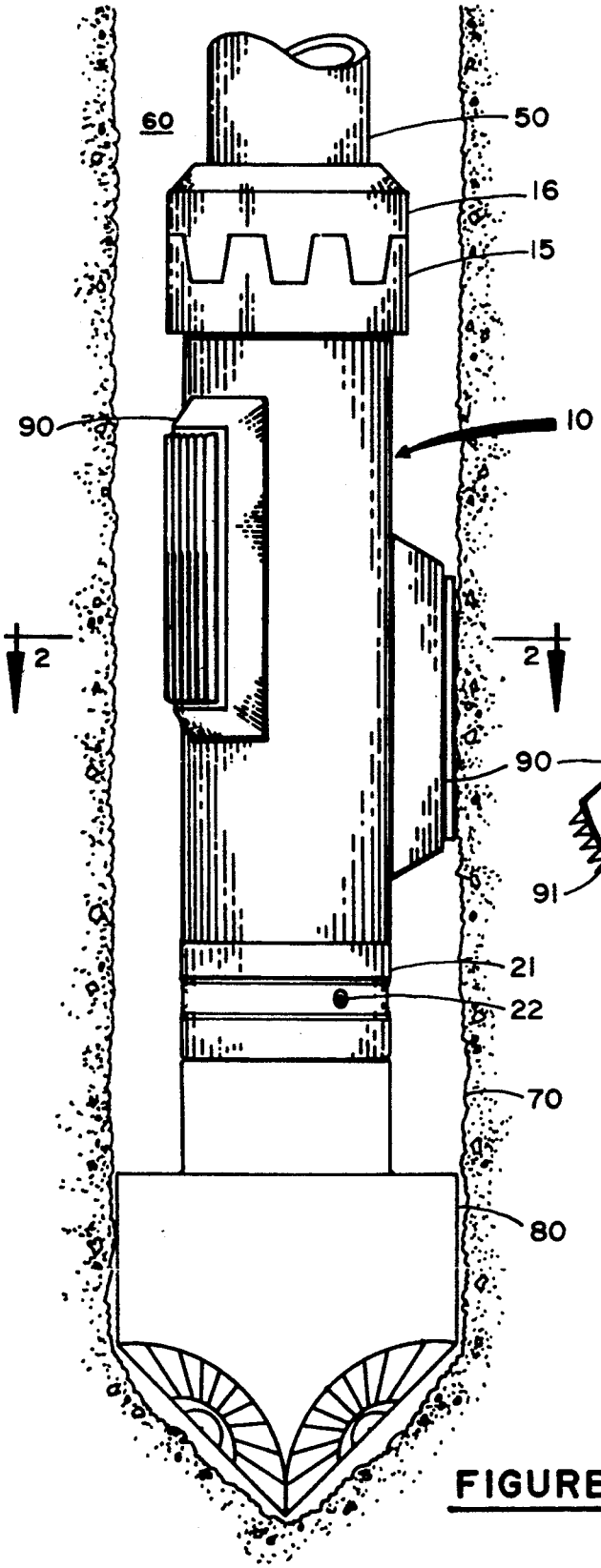
FIG. 1 illustrates a side view of a preferred embodiment of the invention attached to the drill string within a borehole.
Figure 3:
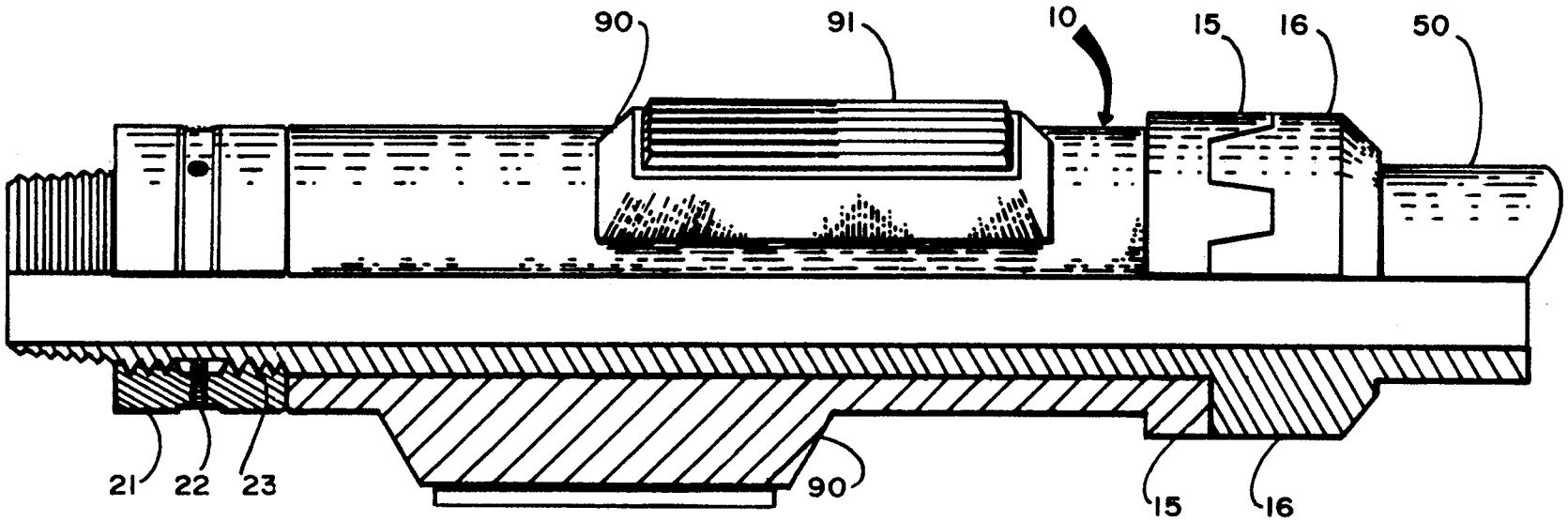
FIG. 3 is a longitudinal view, partly in cross section, of a preferred embodiment of the invention, taken along lines 3—3 of FIG. 2.
Figure 4:
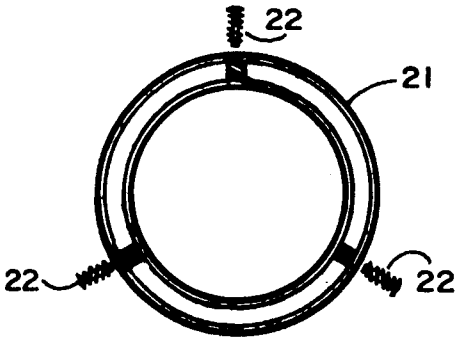
FIG. 4 is a transverse cross section of the locking ring of a preferred embodiment of the invention.

As best can be seen by reference to FIG. 1 and FIG. 3, in this embodiment a portion of the stabilizer slips on over the drill string 50, while parts of the stabilizer are incorporated into the drill string 50. The drill string 50 as shown in FIG. 1 and FIG. 3 is representative of any of the numerous generally cylindrical pieces of equipment which may comprise the drill string, including for example, down-hole motors (including bent-housing mud motors), drill pipe, bent-subs and hydraulic bent-subs, and drill collars. The drill string 50 and stabilizer operate within a borehole 60 which is drilled through various formations 70. The stabilizer is usually placed on the drill string 50 in close proximity to the drill bit 80, but may be located at any longitudinal location along the drill string 50.

Figure 2:
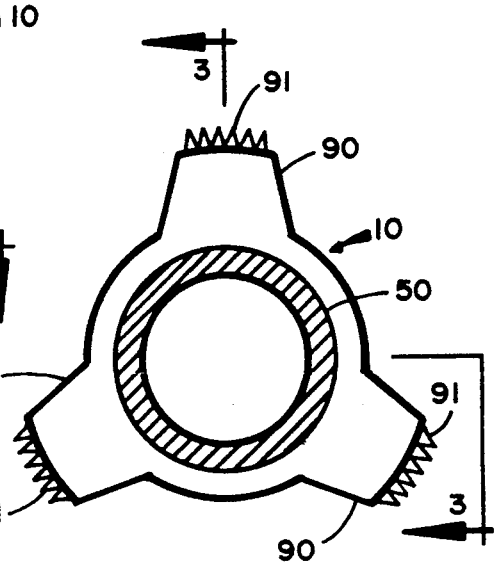
FIG. 2 is a transverse cross-section of a preferred embodiment of the invention, taken along lines 2—2 of FIG. 1.

The stabilizer has a generally cylindrical tubular steel body 10. A plurality of ribs 90 are formed on the outside of the stabilizer body 10. This embodiment of the stabilizer has three ribs 90, equally spaced around the stabilizer body 10. The spacing of the ribs 90 around the stabilizer body 10 can best be seen in FIG. 2. Those skilled in the art will readily understand that the ribs need not be equally spaced around the stabilizer body 10, and need not be of equal length. In some embodiments the off-set rib or ribs 90 are longer than the other ribs 90. The outermost surfaces of each rib 90 may include a plurality of wear resistant inserts 91, made from a material such as tungsten carbide. The outermost surfaces of each rib 90 are equidistant from the centerline of the drill string 50, resulting in a centering of the drill string 50 in the bore-hole 60 when operating at full gage. The ends of each rib 90 are tapered down to the stabilizer body 10, as best seen in FIG. 3, to facilitate entry and exit of the stabilizer into the borehole 60, and to lessen the chance that the stabilizer will hang up on obstructions in the borehole 60. The major components of the stabilizer are preferably made from machined steel, or may be made from a casting or forging. The ribs 90 may be an intergrally formed part of the stabilizer body or may be separately formed and attached to the stabilizer body by some means, such as by welding.

One of the ribs 90 in this embodiment is displaced laterally along the stabilizer body 10 from the other two ribs 90. This is best illustrated in FIG. 1 and FIG. 3. During directional drilling, the laterally displaced rib 90 is oriented toward the low side of the borehole 60 (the side closest to a true vertical bore), in a down-hole direction, and remains so oriented during directional drilling when only the drill bit 80 is rotated using a down-hole motor. In this manner, the laterally displaced rib 90 constantly gives support to the drill bit 80, reducing excessive vibration, but still allows the angular and directional deviation desired by use of a bent-sub or bent-housing mud motor to proceed even though the stabilizer is full-gage.

The stabilizer body 10 can be radially adjusted to any desired orientation relative to the drill string 50. The ability to so radially orient the stabilizer body 10 assures that the laterally displaced rib 90 can be located such that it contacts the low side of the borehole 60 during directional drilling. In this embodiment, the ability to easily adjust the radial orientation of the stabilizer body 10 is achieved through the use of interacting splines 15 and 16. Those skilled in the art will readily understand that other similar indexing means can be used to radially orient the stabilizer body. As can best be seen in FIG. 1 and FIG. 3, spline 15 is attached to or incorporated into the stabilizer body 10 and spline 16 is attached to or incorporated into the drill string 50. The two splines 15 and 16 are in reverse orientation relative to each other such that the keyed edges of the splines 15 and 16 may interact. The teeth of the splines 15 and 16 are sufficiently narrow to allow a great selection of radial orientations, but should be wide enough to maintain their integrity under arduous drilling conditions.

As can best be seen in FIG. 3, in this embodiment the spline 16 is incorporated into the drill string 50. The spline 16 can be machined as an integral part of the bottom section of the mud motor. This application is particularly useful when the stabilizer is used with a bent-housing mud motor. Alternatively, the spline 16 may be secured to the drill string 50 using any means with sufficient gripping strength to prevent slippage of the spline 16 around the drill string. A securing means which distributes any required compressive forces equally around the drill string 50 is desired in order to prevent deforming the drill string 50. The upper surfaces of the spline 16 are tapered to prevent the spline from hanging up on obstructions in the borehole.

The stabilizer body 10 slides along the drill string 50 until the spline 15 incorporated into the stabilizer body 10 interacts with the spline 16 incorporated into the drill string 50, and prevents further motion of the stabilizer body 10 both radially and longitudinally along the drill string 50. To secure the stabilizer body 10 in this longitudinal and radial position, this embodiment uses a locking nut 21 and locking screws 22. The locking nut 21 slides over the drill string 50 and engages the threads 23 incorporated into the drill string 50. The threads 23 can be machined as an integral part of the bottom section of a mud motor or other down hole equipment. The locking nut 21 is then doubly secured to the drill string 50 using the locking screws 22. Those skilled in the art will appreciate that other means to secure the stabilizer body 10 in its radial and longitudinal orientation may be utilized so long as securing means can be readily removed to allow for radial adjustment of the stabilizer body 10. It will also be readily appreciated by those skilled in the art that various length stabilizer bodies can be utilized by the addition of spacer sections (not pictured) between or incorporated into the locking nut and the stabilizer body.

Radial adjustment is accomplished by loosening the locking nut 2 and sliding the stabilizer body 10 down the drill string 50 until the spline 15 disengages the spline 16. The stabilizer body 10 may then be rotated to a new radial position relative to the drill string 50. When the desired radial position is achieved, the stabilizer body 10 is moved back toward the spline 16 until the splines 15 and 16 again engage. The locking nut 21 is then replaced and resecured to the drill string 50 using the locking screws 22 or other securing means.

In operation, the stabilizer is made up on the drill string by first installing the portion of the drill string containing the machined spline 16 and securing threads 23 in the drill string 50. Alternatively, a spline 16 and securing threads 23 can be secured to a section of the drill string. This application may require the use of a sleeve (not pictured) between the securing threads 23 and spline 16 which acts as a spacer to support the stabilizer body 10. The stabilizer body 10 is then slipped over the drill string 50. After rotating the stabilizer body 10 to the desired radial position, the stabilizer body 10 is slipped further along the drill string 50 until the spline 15 on the stabilizer body 10 engages the spline 16 incorporated into the drill string 50. With the splines 15 and 16 fully engaged, the locking nut 21 is slipped over the drill string 50 and rotated until it abuts the stabilizer body 10. The locking nut 21 is then doubly secured to the drill string 50 using the locking screws 22 or other securing means.

Having disclosed the subject matter of this invention, it should be obvious that many substitutions, variations, and modifications of this device are possible in light of the above teachings. It is therefore intended that all matter contained in the accompanying specification shall be interpreted as illustrative only, and not in a limiting sense. The invention as described should only be limited by the breadth and scope of the appended claims.

We claim:

1. A stabilizer for supporting and directing a drill bit during directional drilling and for spacing the drill string from the wall of a borehole during conventional drilling, the stabilizer comprising;

a stabilizer body having a plurality of longitudinal ribs, with the outermost surfaces of said ribs being equidistant form the centerline of the drill string, with one or more of said ribs being laterally displaced relative to the outer said ribs, and means for securing said stabilizer body to the drill string, wherein said securing means includes means for radially adjusting said stabilizer body relative to the drill string, wherein said radially adjusting means comprises; a plurality of interacting splines, and a removable locking nut abutting said stabilizer body whereby the interaction of said splines is maintained.

2. A stabilizer according to claim 1 wherein said stabilizer body has three longitudinal ribs equally spaced around said stabilizer body, with one of said ribs being laterally displaced relative to the other two ribs.

* * * * *